US009004926B2

(12) United States Patent
Ozawa et al.

(10) Patent No.: US 9,004,926 B2
(45) Date of Patent: Apr. 14, 2015

(54) FUSE BLOCK AND ELECTRIC CONNECTION BOX HAVING THE SAME

(75) Inventors: Keisuke Ozawa, Makinohara (JP); Mitsuji Kubota, Toyota (JP)

(73) Assignee: Yazaki Corporation, Tokyo (JP)

( * ) Notice: Subject to any disclaimer, the term of this patent is extended or adjusted under 35 U.S.C. 154(b) by 57 days.

(21) Appl. No.: 13/534,387

(22) Filed: Jun. 27, 2012

(65) Prior Publication Data

US 2013/0005194 A1 Jan. 3, 2013

(30) Foreign Application Priority Data

Jun. 28, 2011 (JP) ..... 2011-142587

(51) Int. Cl.

*H01R 12/00* (2006.01)
*H01H 85/20* (2006.01)
*H01R 12/72* (2011.01)

(52) U.S. Cl.

CPC ..... *H01H 85/2035* (2013.01); *H01R 12/724* (2013.01); *H01H 2085/208* (2013.01); *H01H 2085/2085* (2013.01)

(58) Field of Classification Search

USPC ..... 439/76.2, 949, 620.27, 541.5, 76.1, 439/620.12, 620.26, 620, 27, 620.29, 620.3, 439/620.33, 620.34; 200/50.07

See application file for complete search history.

(56) References Cited

U.S. PATENT DOCUMENTS 6,835,073 B2 * 12/2004 Kobayashi ..... 439/76.2
7,544,065 B2 * 6/2009 Ito ..... 439/76.2
8,070,534 B2 12/2011 Makino et al.
2009/0163085 A1 * 6/2009 Makino et al. ..... 439/701
2010/0317241 A1 * 12/2010 Sugiura et al. ..... 439/733.1

FOREIGN PATENT DOCUMENTS

| | | | |
|---|---|---|---|
| CN | 201725937 | U | 1/2011 |
| JP | H06-29051 | A | 2/1994 |
| JP | H10-149865 | A | 6/1998 |
| JP | 2002-171641 | A | 6/2002 |
| JP | 2006-333583 | A | 12/2006 |
| JP | 2009-152108 | A | 7/2009 |

OTHER PUBLICATIONS

Chinese Office Action dated Mar. 31, 2014 issued for corresponding Chinese Patent Application No. 201210216959.X.
Office Action mailed on Feb. 17, 2015 issued for corresponding Japanese Patent Application No. 2011-142587.

* cited by examiner

*Primary Examiner* — Abdullah Riyami
*Assistant Examiner* — Harshad Patel
(74) *Attorney, Agent, or Firm* — Locke Lord LLP

(57) ABSTRACT

For providing a fuse block in which a printed circuit board can be miniaturized, the fuse block includes a plurality of busbars formed into an L-shape. Each of the busbars is provided at one end thereof with at least one tuning-fork shaped connecting portion to be connected with a fuse, and at the other end thereof with at least one board connecting portion to be connected with a printed circuit board by soldering. The busbars are arranged in parallel along a direction X and overlapped along a direction Y to form four layers. The board connecting portion of the busbar in a third layer numbered from the printed circuit board and the board connecting portion of the busbar in a second layer are arranged in one row on one straight line, so that total number of the rows is smaller than total number of the layers.

9 Claims, 8 Drawing Sheets

FUSE BLOCK AND ELECTRIC CONNECTION BOX HAVING THE SAME

TECHNICAL FIELD

This invention relates to a fuse block mounted on a circuit board so as to distribute electric power, and an electric connection box having the fuse block.

BACKGROUND ART

Various electronic apparatuses are mounted at an automobile. An electric connection box supplying electric power and transmitting data signals to the various electronic apparatuses are provided suitably at suitable positions in the automobile. In the present invention, a junction block (or junction box), fuse block (fuse box) and relay block (relay box) are called an electric connection box as a generic name hereafter.

The electric connection box has various structure according to a model of the automobile. For example, the electric connection box has a fuse block 201 mounted at a circuit board 213 for distributing electric power supply (see Patent Document 1).

The fuse block 201 is formed by a metal plate, and includes a plurality of busbars 202, 203, 204, 205 bent into L-shape and a hold member 214 made of synthetic resin for holding the busbars 202, 203, 204 and 205. Each of busbars 202, 203, 204 and 205 is provided at one end thereof with at least one tuning-fork shaped connecting portion 206 to be connected with a fuse 209, and at the other end thereof with at least one board connecting portion 207 to be connected with a printed circuit board 213 by soldering. In FIG. 10, a joint portion 208 between the tuning-fork shaped connecting portion 206 and the board connecting portion 207 is shown.

The busbars 202, 203, 204 and 205 are arranged in parallel along a direction X and overlapped to form four layers along a direction Y. In other words, the busbars, in which the tuning-fork shaped connecting portions 206 are arranged in parallel along the direction X, are overlapped into four layers along the direction Y, and the four board connecting portions 207 provided in a line perpendicular to the direction X are arranged in a row along a direction Z.

CITATION LIST

Patent Document

Patent Document 1: Japan Patent Application Published No. 2009-152108

SUMMARY OF INVENTION

Objects to be Solved

According to an electric connection box having the above usual fuse block, it is required to further miniaturize the printed circuit board 213.

According to the above requirement, an object of the present invention is to provide a fuse block in which a printed circuit board can be miniaturized and an electric connection box having the fuse block.

How to Attain the Object of the Present Invention

In order to attain the above object, the present invention is to provide a fuse block in which a plurality of busbars, which is formed into an L-shape and provided at one end thereof with at least one tuning-fork shaped connecting portion connected to a fuse and at the other end thereof with at least one board connecting portion connected to a printed circuit board by soldering, is provided; and a plurality of layers, in each of which some of the tuning-fork shaped connecting portions of the plurality of busbars are arranged in parallel in the same layer, is provided; and the board connecting portion of the busbar in at least one layer and the board connecting portion of the other busbar in the layer just under the at least one layer are arranged in a row on a straight line; and total number of the rows, in which the board connecting portions are arranged, is smaller than total number of the layers, in which the tuning-fork shaped connecting portions are arranged.

An electric connection box according to the present invention includes the fuse block mentioned above, a printed circuit board in which the fuse block is mounted, and a case receiving the fuse block and the printed circuit board.

Effects of the Invention

According to the present invention, the board connecting portion of the busbar in the at least one layer and the board connecting portion of the other busbar in the layer just under the at least one layer are arranged in the row on the straight line, and the total number of the board connecting portion is smaller than the total number of the tuning-fork shaped connecting portion in each of the at least one layer and the layer just under the at least one layer. Thereby, mounting area of board connecting portion in the printed circuit board can be reduced so that the printed circuit board can be miniaturized.

According to the present invention, the electric connection box includes the fuse block mentioned above, the printed circuit board in which the fuse block is mounted, and the case receiving them, so that the electric connection box can be miniaturized.

DESCRIPTION OF EMBODIMENTS

A fuse block and an electric connection box according to one embodiment of the present invention will be described with reference to FIGS. 1-9.

Figure 9:
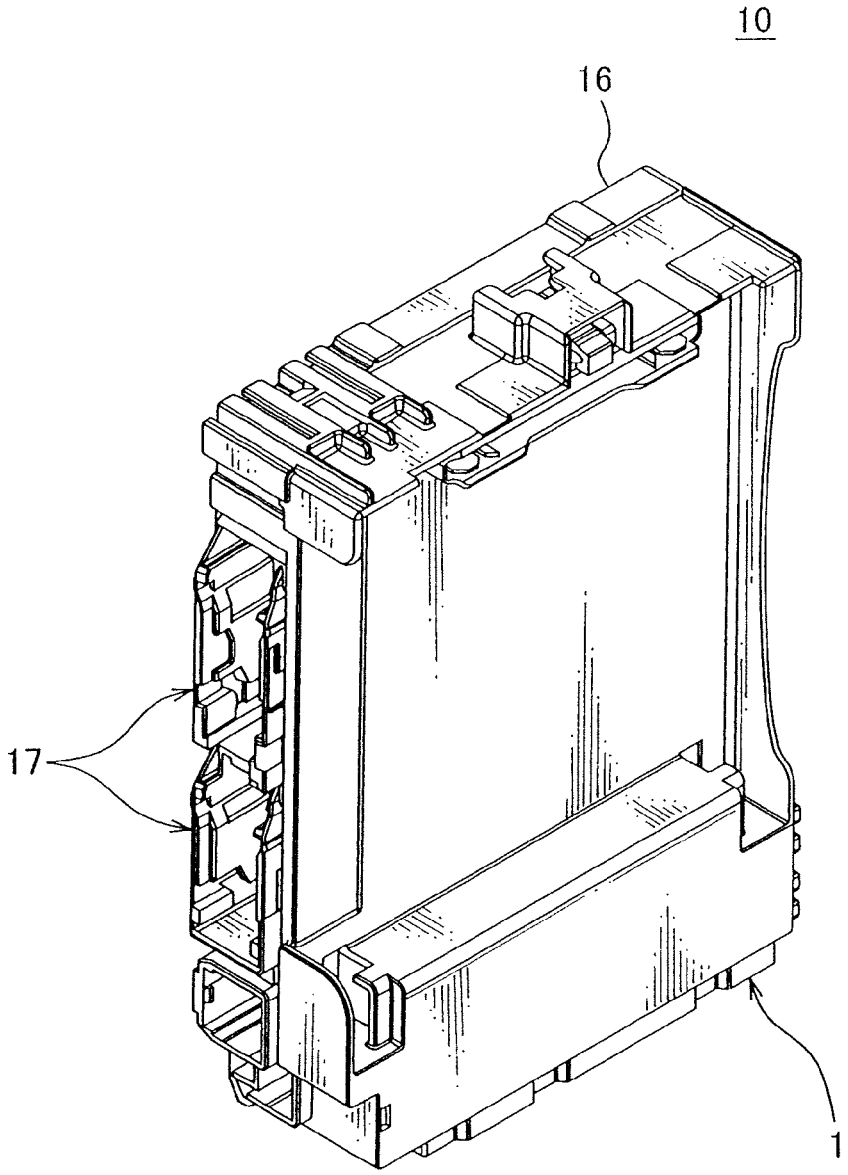
FIG. 9 is a perspective view of an electric connection box including the fuse block shown in FIG. 1.

The electric connection box 10 according to the present invention is mounted at a car so as to supply electric power and transmit data signals to an electronic apparatus arranged at the car. The electric connecting box as shown in FIG. 9 includes a fuse block 1 distributing the electric power supplied from one of a battery and an alternator, connector blocks 17 to be connected with a wiring harness, a printed circuit board 13 (shown in FIG. 2A) and a case 16 receiving the fuse block 1, the connector blocks 17 and the print circuit board 13.

Figure 1:
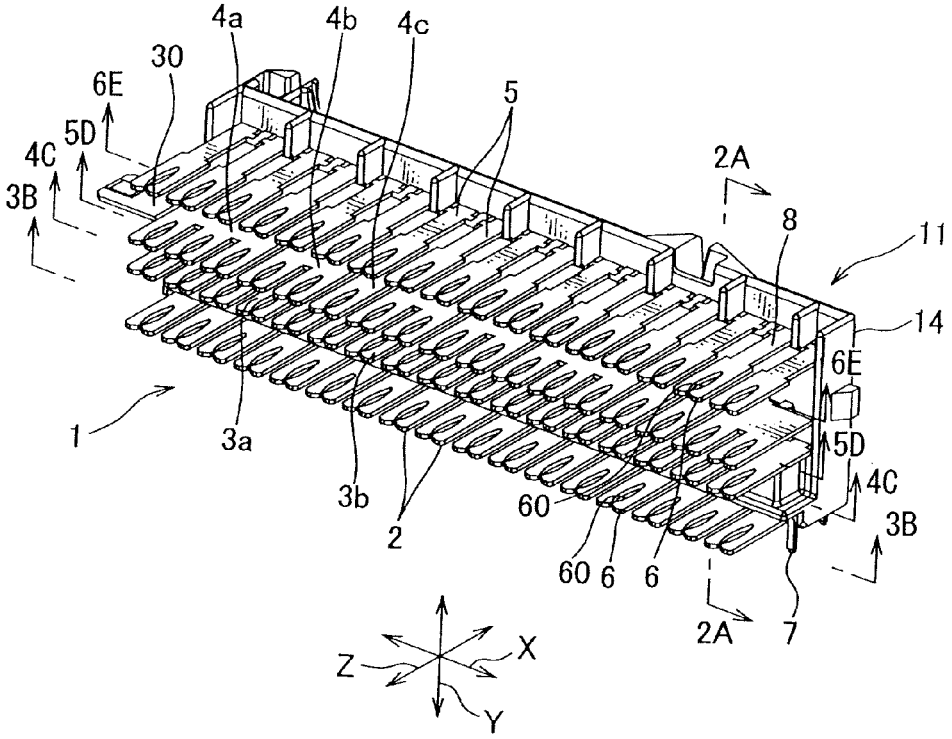
FIG. 1 is a perspective view of an embodiment of a fuse block of according to the present invention.
Figure 2A:
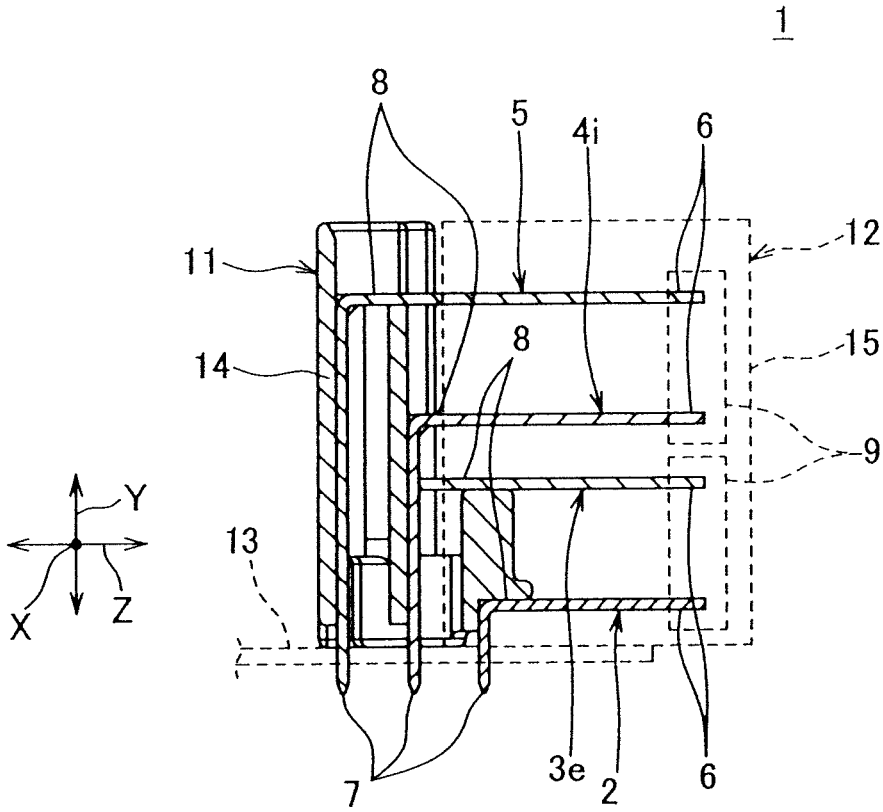
FIG. 2A is a cross-sectional view taken along the line 2A-2A in FIG. 1.
Figure 3B:
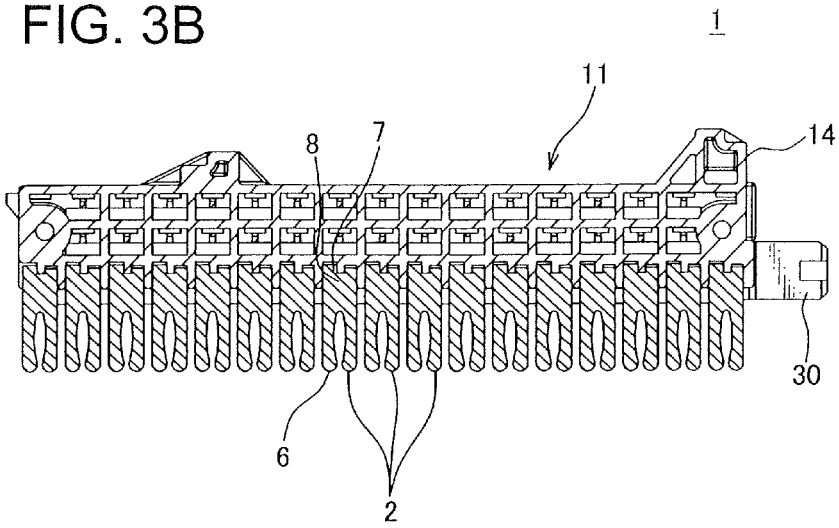
FIG. 3B is a cross-sectional view taken along the line 3B-3B in FIG. 1.

The fuse block 1 as shown in FIGS. 1 and 2A includes a busbar assembly body 11 in which a plurality of busbars 2, 3*a*-3*e*, 4*a*-4*i*, and 5 is supported by a holding member 14 made of synthetic resin; and a fuse assembly body 12 in which a plurality of fuses 9 is supported by a holding member 15 made of synthetic resin. When the busbar assembly body 11 and the fuse assembly body 12 are assembled to each other as shown in FIG. 2A, each of busbars 2, 3*a*-3*e*, 4*a*-4*i* and 5 and terminals of each fuse 9 are electrically connected.

The busbar 2, 3*a*-3*e*, 4*a*-4*i*, 5 is formed by pressing copper sheet. Each of busbars 2, 3*a*-3*e*, 4*a*-4*i* and 5 is provided at one end thereof with at least one tuning-fork shaped connecting portion 6 to be connected with the fuse 9, and at the other end thereof with at least one board connecting portion 7 to be connected to the printed circuit board 13 by soldering. The busbar 2, 3*a*-3*e*, 4*a*-4*i*, 5 is formed into an L-shape by bending a joint portion 8 between the tuning-fork shaped connecting portion 6 and the board connecting portion 7.

The tuning-fork shaped connecting portion 6 is configured into a tuning-fork shape having a slit 60 which the terminal of the fuse 9 can be inserted into.

The board connecting portion 7 is formed into a pin shape which can be inserted in a through-hole of the printed circuit board 13. The board connecting portion 7 is inserted into the through-hole of the printed circuit board 13 and fixed to a printed wiring of the printed circuit board 13 by soldering.

The busbars 2, 3*a*-3*e*, 4*a*-4*i* and 5 are arranged in parallel to each other along a direction X and simultaneously overlapped on each along a direction Y to form four layers. The direction Y is a direction parallel to a direction of thickness of the printed circuit board 13. The direction X is a direction perpendicular to the direction Y. In short, four layers, in each of which the tuning-fork shaped connecting portions 6 are arranged in parallel to each other along the direction X, are arranged along the direction Y. In the embodiment, the nearest layer to the printed circuit board 13 is designated to a first layer, and the farthest layer to the printed circuit board 13 is designated to a fourth layer.

Figure 7:
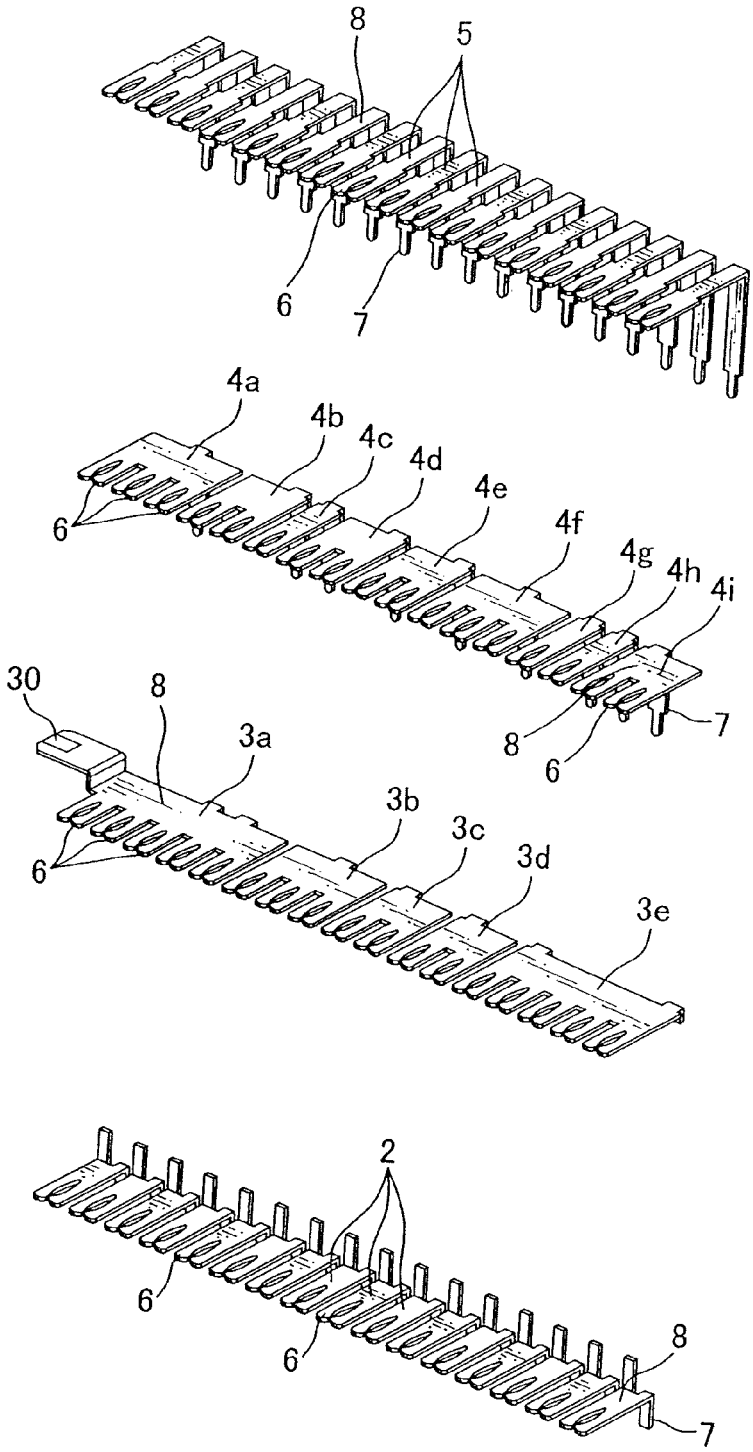
FIG. 7 is a perspective view of busbars configuring the fuse block shown in FIG. 1.

As shown in FIG. 7, each busbar 2 arranged in the first layer and each busbar 5 arranged in the fourth layer respectively include one tuning-fork shaped connecting portion 6 and one board connecting portion 7. Each busbar 3*a*-3*e* arranged in the second layer includes two or more tuning-fork shaped connecting portions 6 and one or more board connecting portion 7. In the second layer, total number of the board connecting portion 7 is smaller than total number of the tuning-fork shaped connecting portion 6. The busbar 3*a* arranged at an end of the second layer is provided with a power input terminal 30, to which electric power from the battery or alternator is inputted (see FIG. 8). Each of three busbars 4*c*, 4*g*, 4*h* of the busbars 4*a*-4*i* arranged in the third layer includes one tuning-fork shaped connecting portion 6 and one board connecting portion 7. Each of the busbars 4*a*, 4*b*, 4*e*, 4*f* and 4*i* other than the three busbars includes two or more tuning-fork shaped connecting portions 6 and one or more board connecting portion 7. In the third layer, total number of board connecting portion 7 is smaller than total number of the tuning-fork shaped connecting portion 6.

Figure 8:
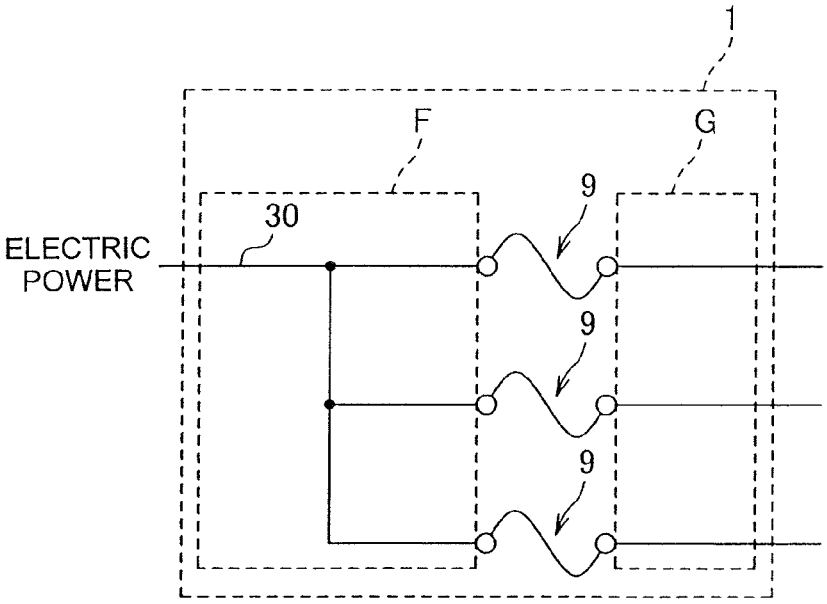
FIG. 8 is a schematic diagram of a circuit of the fuse block shown in FIG. 1.

Each of the busbars 2 arranged in the first layer and each of the busbars 5 arranged in the fourth layer are located at an area G in FIG. 8, that is a position downstream from the fuse 9. Each of the busbars 3*a*-3*e* arranged in the second layer and each of the busbars 4*a*-4*a* arranged in the third layer are located at an area F in FIG. 8, that is a position upstream from the fuse 9.

The above-mentioned busbars 2, 3*a*-3*e*, 4*a*-4*i* and 5 are inserted into holes arranged at the holding member 14 and held by the holding member 14 as shown in FIGS. 3B-6E. According to the present invention, instead of the above embodiment, the busbars 2, 3*a*-3*e*, 4*a*-4*i* and 5 can be formed integratedly in the holding member 14 by insertion molding.

Figure 4C:
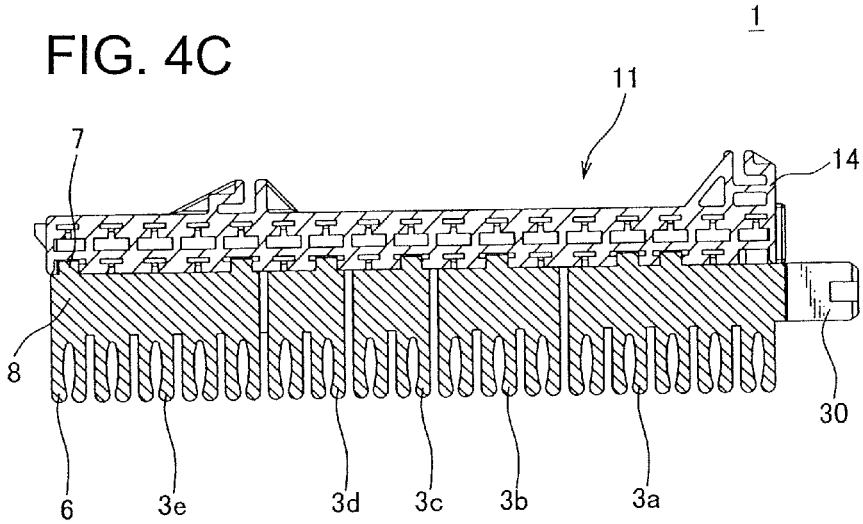
FIG. 4C is a cross-sectional view taken along the line 4C-4C in FIG. 1.
Figure 5D:
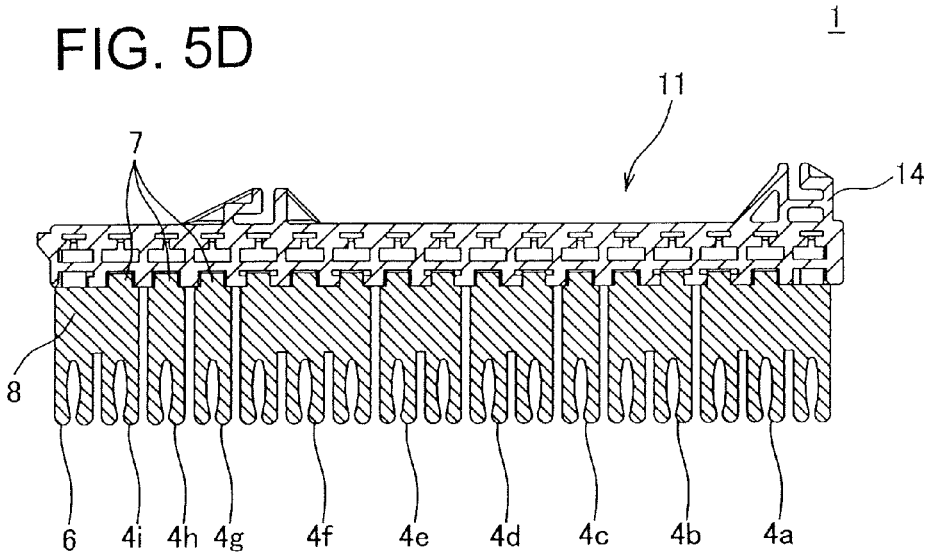
FIG. 5D is a cross-sectional view taken along the line 5D-5D in FIG. 1.
Figure 6E:
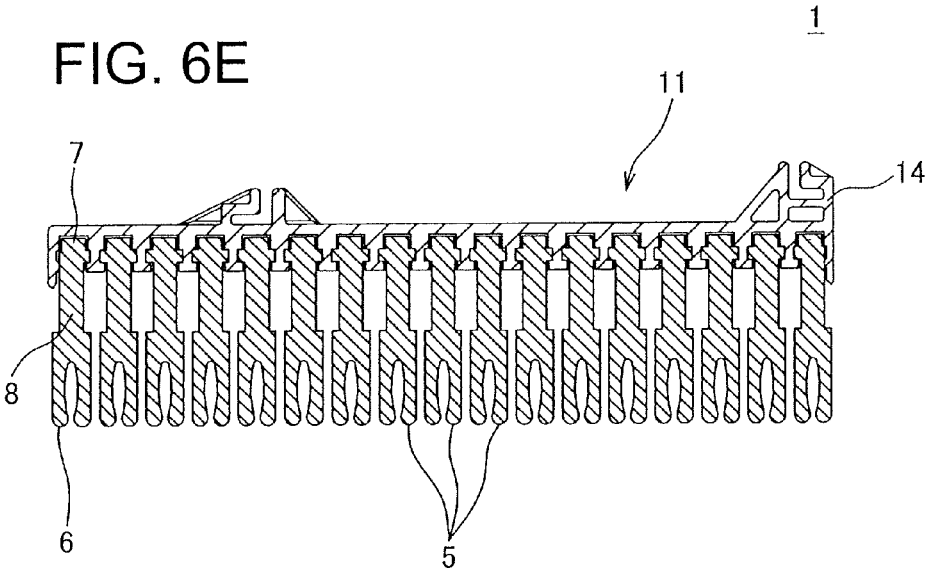
FIG. 6E is a cross-sectional view taken along the line 6E-6E in FIG. 1.

The fuse block according to the present invention is configured to provide the board connecting portions 7 of the busbars 4*a*-4*i* arranged in the third layer and the board connecting portions 7 of the busbars 3*a*-3*e* arranged in the second layer in one straight line along the direction X. In other words, as shown in FIGS. 4C and 5D, the board connecting portions 7 of the busbars 4*a*-4*i* arranged in the third layer are located at spaces between each of the board connecting members 3*a*-3*e* arranged in the second layer. In the fuse block 1 according to the present invention, three rows, in each of which the board connecting members 7 are arranged in one straight line along the direction X, are provided along a direction Z (see FIG. 2A). The direction Z is a direction perpendicular to both the direction Y and the direction X.

Figure 10:
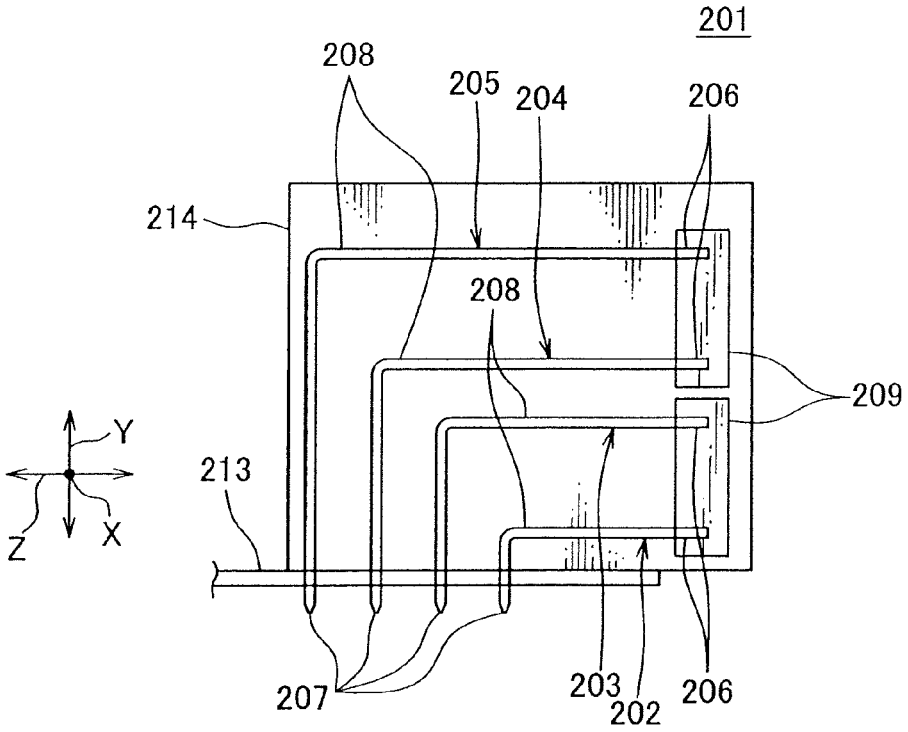
FIG. 10 PRIOR ART
FIG. 10 is an illustration showing main components of a fuse block configuring an electric connection box by prior art.

Accordingly, in the fuse block 1 of the present invention, the number of rows along the direction Z (three rows), in each of which the board connecting portions 7 are arranged in one straight line along the direction X, is smaller than the number of layers along the direction Y (four layers), in each of which the tuning-fork shaped connecting portions 6 are arranged in parallel along the direction X. In a usual fuse block (see FIG. 10), a number of rows along the direction Z, in each of which the board connecting portions are arranged in one straight line along the direction X, is same as a number of layers along the direction Y, in each of which the tuning-fork shaped connecting portions are arranged in parallel along the direction X. Thus, the fuse block according to the present invention is configured to have the above structure, so that a mounting area of the board connecting portions 7 on the printed circuit board 13 can be reduced. Thereby, a length along the direction Z of the printed circuit board 13 can be shortened, so that the printed circuit board 13 and the electric connection box 10 can be miniaturized.

In the above embodiment, the board connecting portions 7 of the busbars 4*a*-4*i* in the third layer and the board connecting portions 7 of the busbars 3*a*-3*e* in the second layer are arranged in one straight line along the direction X. When busbars are stacked to form eight layers along the direction Y, the board connecting portions of the busbars in the sixth layer and the board connecting portions of the busbars in the seventh layer can be arranged in one straight line along the direction X as above second layer and third layer.

The present inventions are described based in the embodiments as mentioned above, but the present invention is not limited in above embodiments. Various change and modifications can be made with the scope of the present invention.

REMARKS

1 Fuse block
2 Busbar
3*a*-3*e* Busbar
4*a*-4*i* Busbar
4, 34 Hole
5 Busbar
6 Tuning-fork shaped connecting portion

7 Board connecting portion
9 Fuse
10 Electric connecting box
13 Printed circuit board

The invention claimed is:

1. A fuse block, comprising:

a plurality of busbars formed into an L-shape by bending only once a straight-band-shaped joint portion and provided at one end of each of the busbars with at least one tuning-fork shaped connecting portion connected to a fuse, and at the other end thereof with at least one board connecting portion connected to a printed circuit board by soldering;

wherein the plurality of busbars is arranged along a first direction (X) and arranged along a second direction (Y), wherein the tuning-fork shaped connecting portions of the busbars are arranged in a plurality of layers in the second direction (Y), and the board connecting portions of the busbars are arranged in a plurality of rows separated from each other along a third direction (Z) perpendicular to both the first direction and the second direction, and wherein a total number of the rows in which the board connecting portions are arranged is less than a total number of the layers in which the tuning-fork shaped connecting portions are arranged.

2. An electric connection box, comprising the fuse block according to claim 1, the printed circuit board in which the fuse block is mounted, and a case receiving the fuse block and the printed circuit board.

3. The fuse block according to claim 1, wherein one of the board connecting portions of one of the bus bars and another of the board connecting portions of another of the bus bars just under the one of the bus bars are arranged in a line along the first direction (X).

4. The fuse block according to claim 1, wherein the board connecting portion in one of the plurality of layers and the board connecting portion in the other layer next to the one of the plurality of layers are arranged in a line along the first direction (X).

5. The fuse block according to claim 1, wherein the board connecting portion in one of the plurality of layers is arranged between the respective board connecting portions in the other layer next to the one of the plurality of layers.

6. The fuse block according to claim 1, wherein each of the board connecting portions are vertically-inserted into the printed circuit board.

7. The fuse block according to claim 1, wherein the tuning-fork shaped connecting portions are arranged in parallel with the printed circuit board.

8. The fuse block according to claim 1, wherein the tuning-fork shaped connecting portion ends are all aligned in the same direction.

9. The fuse block according to claim 1, wherein the tuning-fork shaped connecting portions of the busbars all have board connecting portions which make up the plurality of rows of board connecting portions of the busbars.

* * * * *